US007493941B2

(12) United States Patent
Kawasaki et al.

(10) Patent No.: US 7,493,941 B2
(45) Date of Patent: Feb. 24, 2009

(54) SURFACE TREATMENT METHOD FOR PLATE MATERIAL, AND RADIATING FIN FOR HEAT EXCHANGER

(75) Inventors: Hiraku Kawasaki, Sakai (JP); Shinichirou Kobayashi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 545 days.

(21) Appl. No.: 10/504,764

(22) PCT Filed: Mar. 24, 2003

(86) PCT No.: PCT/JP03/03556

§ 371 (c)(1),
(2), (4) Date: Aug. 17, 2004

(87) PCT Pub. No.: WO03/085349

PCT Pub. Date: Oct. 16, 2003

(65) Prior Publication Data

US 2005/0103481 A1 May 19, 2005

(30) Foreign Application Priority Data

Apr. 10, 2002 (JP) ..... 2002-107868

(51) Int. Cl.
*F28F 19/02* (2006.01)

(52) U.S. Cl. ..... 165/133; 165/134.1

(58) Field of Classification Search ..... 165/133
See application file for complete search history.

(56) References Cited

U.S. PATENT DOCUMENTS

| | | | | |
|---|---|---|---|---|
| 3,128,548 | A | 4/1964 | Zelisko | |
| 3,825,448 | A | 7/1974 | Hartmann et al. | |
| 4,207,662 | A * | 6/1980 | Takenaka | 29/890.047 |
| 5,916,635 | A * | 6/1999 | Ishii et al. | 427/388.2 |
| 6,471,794 | B2 * | 10/2002 | Doko et al. | 148/437 |
| 6,540,015 | B1 * | 4/2003 | Kawachi et al. | 165/164 |
| 2004/0256089 | A1 * | 12/2004 | Kobayashi et al. | 165/133 |
| 2005/0138959 | A1 * | 6/2005 | Howe et al. | 62/515 |

FOREIGN PATENT DOCUMENTS

| | | | |
|---|---|---|---|
| GB | 2 019 884 | A | 11/1979 |
| JP | 62164770 | A * | 7/1987 |
| JP | 62272098 | A * | 11/1987 |
| JP | 63281722 | A * | 11/1988 |
| JP | 03051698 | A * | 3/1991 |
| JP | 04251193 | A * | 9/1992 |
| JP | 6-61969 | U | 9/1994 |
| JP | 07151489 | A * | 6/1995 |
| JP | 08136184 | A * | 5/1996 |
| JP | 08157851 | A * | 6/1996 |
| JP | 08313191 | A * | 11/1996 |

(Continued)

*Primary Examiner*—Allen J Flanigan
(74) *Attorney, Agent, or Firm*—Global IP Counselors

(57) ABSTRACT

The present invention reduces the expense of treating the surfaces of a plate material. This surface treatment method treats the surfaces of a plate material that is rolled with rolling oil and employed as a cooling fin of a heat exchanger, and includes a preparation step and a coating application step. In the preparation step, the plate material is prepared. In the coating application step, a coating is applied to the surface of the plate material without carrying out a degreasing treatment.

13 Claims, 4 Drawing Sheets

FOREIGN PATENT DOCUMENTS

| | | | | |
|---|---|---|---|---|
| JP | 9-77999 | A | | 3/1997 |
| JP | 09078002 | A | * | 3/1997 |
| JP | 09151299 | A | * | 6/1997 |
| JP | 11-61433 | A | | 3/1999 |
| JP | 2000-126863 | A | | 5/2000 |
| JP | 2000301063 | A | * | 10/2000 |
| JP | 2000-328259 | A | | 11/2000 |

* cited by examiner

SURFACE TREATMENT METHOD FOR PLATE MATERIAL, AND RADIATING FIN FOR HEAT EXCHANGER

TECHNICAL FIELD

The present invention relates to a method of treating the surface of a plate material, and more specifically relates to a method of treating the surface of a plate material in which the plate material is rolled with rolling oil, the plate material being employed as cooling fins for heat exchangers.

In addition, the present invention relates to cooling fins for heat exchangers, and in particular relates to plate-shaped fins disposed inside a heat exchanger formed from a plate material that is rolled with rolling oil.

BACKGROUND ART

The outdoor unit and indoor unit of an air conditioner each generally include a heat exchanger for exchanging heat between the heat exchanger and the air surrounding it. A heat exchanger normally includes a plurality of cooling fins, a plurality of heat transfer lines, and air transport means such as a propeller fan or the like. The plurality of cooling fins are plate-shaped members that are disposed with a predetermined gap between each member in the plate thickness direction. The plurality of heat transfer lines are mounted such that they pass through the plurality of cooling fins in the plate thickness direction. The air transport means serves to transport an air flow to the plurality of cooling fins and heat transfer lines.

In this heat exchanger, heat exchange occurs by transporting an air flow with the air transport means through the gaps between adjacent cooling fins, and evaporating or condensing refrigerant that flows inside the heat transfer lines.

The cooling fins are generally composed of a pure aluminum plate material, and the plate material is manufactured by cutting the plate material into predetermined fin shapes by means of a metal die. Before the plate material is cut, a corrosion resistant coating is applied to the plate material to form a corrosion resistant film that will improve the corrosion resistance of the plate material.

However, rolling oil remains on the surface of the plate material because rolling oil is used to roll and manufacture the plate material. Because of this, when the coating is applied to the surface of the plate material, the coating will be repelled by the rolling oil and thus it will be difficult to apply the coating. Accordingly, in a conventional surface treatment, before the coating is applied, the plate material is dipped in a tank of alkaline solution in order to degrease the plate material, and is then dipped in a tank of a chromic acid processing agent in order to both form the corrosion resistant film on the surface thereof and roughen the surface thereof.

This conventional method of treating the surfaces of the plate material is quite expensive because of the need for processing tanks for the degreasing and chromic acid processes.

In addition, because the treatment waste fluid produced by the chromic acid process includes heavy metals and is a problem from an environmental point of view, it will be necessary to dispose of the treatment waste fluid after a predetermined number of treatments. However, when this waste fluid is processed, the running cost thereof is quite expensive because specialized waste fluid tanks must be treated differently, and because the waste fluid must be processed at fixed intervals of time.

SUMMARY OF THE INVENTION

An object of the present invention is to reduce the expense of treating the surfaces of plate material. In addition, another object of the present invention is to carry out this type of surface treatment to obtain cooling fins for heat exchangers.

According to a first aspect of the present invention, a method for treating the surface of a plate material that is rolled with rolling oil includes a first step and a second step. In the first step, the plate material is prepared. In the second step, a coating is applied to the surfaces of the plate material without carrying out a degreasing treatment.

In this method, a coating can be applied to a plate material without performing a degreasing treatment, and thus a conventional degreasing treatment tank will not be necessary and costs will be reduced.

According to a second aspect of the present invention, the surface treatment method of the first aspect of the present invention is provided, in which in the second step the coating is applied to the surface of the plate material without carrying out a surface roughing treatment.

In this method, a coating can be applied to a plate material without performing a surface roughing treatment, and thus a conventional chromic acid treatment tank will not be necessary and costs will be reduced. In addition, running costs can be avoided because waste fluid treatment need not be performed.

According to a third aspect of the present invention, the surface treatment method of the first or second aspect of the present invention is provided, in which in the second step the coating is applied to the surface of the plate material by transporting the plate material at a speed of 50 m/min or less.

In this method, the coating having a high viscosity and not easily repelled by oil can be employed because the coating is applied to the plate material at a comparatively slow speed. Thus by adopting this method, a degreasing treatment can be omitted.

According to a fourth aspect of the present invention, the surface treatment method of the third aspect of the present invention is provided, in which the coating has a viscosity that is related to the application speed at which the coating is applied to the plate material.

When the speed at which the coating is applied changes, the viscosity of the coating that can be used at that application speed will also change. Here, the viscosity of the coating that can be used is related to the speed at which the coating is applied.

According to a fifth aspect of the present invention, the surface treatment method of any one of the first to fourth aspect of the present invention is provided, in which in the second step the coating is dried in atmospheric air at a temperature between 240° C. and 270° C.

In this method, rolling oil remaining on the plate material will be easily dissolved in the coating because the coating is dried in atmospheric air at a comparatively high temperature. Thus, even if a degreasing treatment is omitted, a coating film can be stably formed on the surface of the plate material.

According to a sixth aspect of the present invention, the surface treatment method of any one of the first to fifth aspect of the present invention is provided, in which the coating includes a corrosion resistant coating and a hydrophilic coating. In addition, the second step includes a third step and a fourth step. In the third step, the corrosion resistant coating is applied to the surface of the plate material. In the fourth step, the hydrophilic coating is applied to the surface of the plate material after the third step.

When the cooling fins are, for example, employed in a heat exchanger of an indoor unit, they will be required to have hydrophilic properties in addition to a resistance to corrosion. In this situation, after a corrosion resistant film is formed on the surface of the plate material, a hydrophilic film will be formed on top of the corrosion resistant film.

Here, this method is primarily directed at a surface treatment for a plate materials employed as cooling fins in an heat exchanger for an outdoor unit.

According to a seventh aspect of the present invention, the surface treatment method of any one of the first to sixth aspect of the present invention is provided, in which in the fourth step the plate material is transported in a transport path that is the same as the transport path of the third step but in a direction that is opposite to that of the third step.

The plate material is normally transported at a predetermined speed and coatings are applied thereto and dried. However, in this method, both the corrosion resistant coating and the hydrophilic coating are applied in the same path, and thus both drying steps can be performed by arranging, for example, only one drying oven in the transport path. Because of this, costs can be further reduced, and work efficiency can be improved.

According to an eighth aspect of the present invention, the surface treatment method of the seventh aspect of the present invention is provided, in which in the third step the coating is applied to the plate material in atmospheric air that is at a temperature that is lower than that of the fourth step.

In this method, the corrosion resistant coating is applied at a temperature that is lower than the temperature at which the hydrophilic coating is applied, and thus the production of heat history in the corrosion resistant coating can be avoided when the hydrophilic coating is dried.

According to a ninth aspect of the present invention, a plate shaped fin is composed of a plate material that was rolled with a rolling oil. The fin includes a fin unit and a coating film. The coating film is formed on the surfaces of the fin unit. 10 mg or less of the rolling oil are included per 1 $m^2$ of the surface of the fin unit.

The fins have a predetermined amount of rolling oil remaining thereon, which can confirm that the surface treatment did not include a degreasing treatment.

According to a tenth aspect of the present invention, a plate shaped fin is composed of a plate material that was rolled with a rolling oil. The fin includes a fin unit and a coating film. The coating film is formed on the surfaces of the fin unit. And, the coating film has a peak in the infrared spectrum that corresponds to the primary constituent of the rolling oil.

The fin has a portion of the rolling oil remaining thereon in the dissolved state, and thus when the infrared spectrum of the coating film is measured, a peak that corresponds to the primary constituent of the rolling oil will appear. Thus, it can be confirmed that the surface of the fin was treated without a degreasing treatment.

According to an eleventh aspect of the present invention, the fin of the tenth aspect of the present invention is provided, in which the coating film has a peak in the infrared spectrum in a range between 1500 $cm^{-1}$ and 2000 $cm^{-1}$.

A fin having a coating film with a peak in the infrared spectrum in this range is sought because there are many commonly used rolling oils that have a peak in this range.

This fin has a portion of the rolling oil remaining thereon in the dissolved state, and thus when the infrared spectrum of the coating film is measured, a peak that corresponds to the primary constituent of the rolling oil will appear. Thus, it can be confirmed that the surface of the fin was treated without a degreasing treatment.

According to a twelfth aspect of present invention, the fin of any one of the ninth to eleventh aspect of the present invention is provided, in which there are concave and convex portions on the surface of the coating film in a range between 2 and 5 micrometers in the plate thickness direction.

The fin has not had a surface roughing treatment carried out on it, and thus the concave and convex portions on the surface of the coating film are smaller than those produced by a surface roughing treatment, and the convex and concave portions are maintained within the aforementioned range. Thus, it can be confirmed that the surface of the fin was treated without a surface roughing treatment.

According to a thirteenth aspect of the present invention, the fin employs a plate material treated by means of the surface treatment method of any one of the first to eighth, seventeenth and eighteenth aspects of the present invention.

This cooling fin is manufactured by employing a plate material treated by the aforementioned surface treatment method, and was manufactured via a treatment process that reduces the cost of equipment or the like for surface treatment.

According to a fourteenth aspect of the present invention, the fin of any one of the ninth to thirteenth aspects of the present invention is provided, the fin being disposed inside a heat exchanger for radiating heat.

According to a fifteenth aspect of the present invention, the fin of the ninth to fourteenth aspects of the present invention is provided, in which the plate material is made from pure aluminum.

According to a sixteenth aspect of the present invention, a plate member is treated by means of a surface treatment method of any of the first to eighth, seventeenth, and eighteenth aspects of the present invention.

According to a seventeenth aspect of the present invention, the surface treatment method of any one of the first to eighth aspects of the present invention is provided, in which the plate material is employed as cooling fins of heat exchangers.

According to an eighteenth aspect of the present invention, the surface treatment method of any of the first to eighth and seventeenth aspects of the present invention is provided, in which the plate material is made from pure aluminum.

PREFERED EMBODIMENTS OF THE INVENTION

[Method of Treating the Surfaces of a Plate Material]

Figure 1:
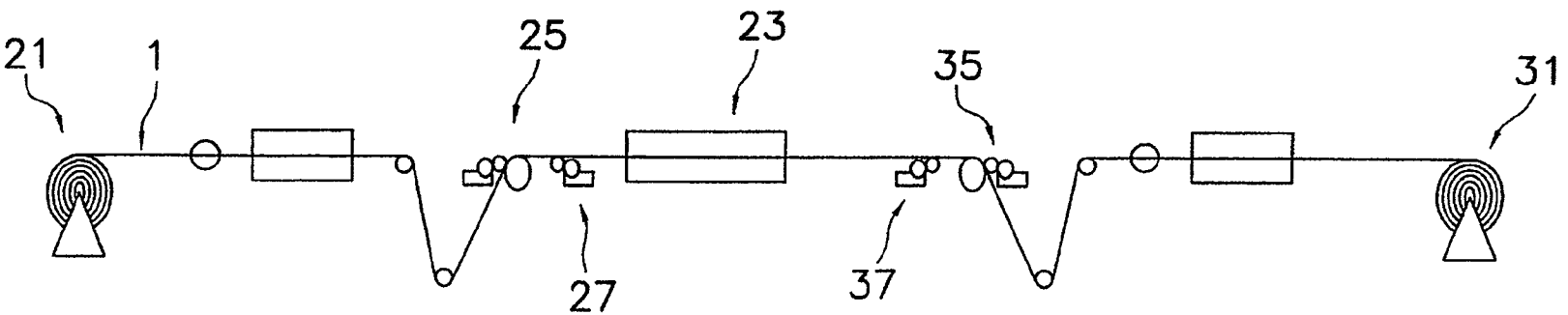
FIG. 1 shows a summary of a method of treating the surfaces of a plate material according to an embodiment of the present invention.

FIG. 1 shows a summary of a surface treatment method according to an embodiment of the present invention.

First, the device that is employed in this surface treatment method will be described.

A plate material 1 is set such that it extends between two coilers 21, 31. The coilers 21, 31 are devices which can respectively unroll and wind up the plate material 1, and the plate material 1 can be transported to either left or right in FIG. 1 by either unrolling the plate material 1 or by winding up the plate material 1.

A drying oven 23 is disposed approximately midway between the two coilers 21, 31, and serves to dry a coating applied to the surfaces of the plate material 1. The drying oven 23 is open in the direction in which the plate material 1 is transported, and the plate material 1 is movably disposed inside the drying oven 23.

A roll coater 25 for applying a corrosion resistant coating (described below) is disposed on the coiler 21 side of the drying oven 23, and a roll coater 35 for applying a hydrophilic coating (described below) is disposed on the coiler 31 side of the drying oven 23. The roll surface of the roll coater 25 is mesh finished in order to increase the retentivity of the coating, and the roll surface of the roll coater 35 is dull-finished.

In addition, processing units 27, 37 for affixing a processing agent to the surface of the coating are respectively disposed on the downstream side in the transport direction of the roll coaters 25, 35, and cooling blowers 29, 39 for cooling the plate material 1 heated by the drying oven 23 are disposed further downstream from the drying oven 23.

Next, the surface treatment method will be described.

This method serves to treat the surface of a plate material 1 that was rolled with rolling oil. The plate material 1 is employed primarily for cooling fins that are disposed inside heat exchangers for the indoor and outdoor units of an air conditioner.

This method includes a preparation step and a coating application step.

In the preparation step, a plate material 1 that is wound into a roll is prepared, and set onto the coilers 21, 31. The plate material 1 is made from pure aluminum, and is manufactured by rolling with a rolling oil.

In the coating application step, a coating is applied to the surfaces of the plate material 1 without carrying out a degreasing treatment and a surface roughing treatment. This step includes a corrosion resistant coating application step and a hydrophilic coating application step.

In the corrosion resistant coating application step, a corrosion resistant coating is applied to the surfaces of the plate material 1 by means of the roll coater 25. In this step, the coating is applied at a fixed speed by means of the roll coater 25 by transporting the plate material 1 to the right in FIG. 1 at a fixed speed. Here, the coating is applied at a speed of 50 m/min or less, and preferably at a speed of 10 to 40 m/min.

Figure 2:
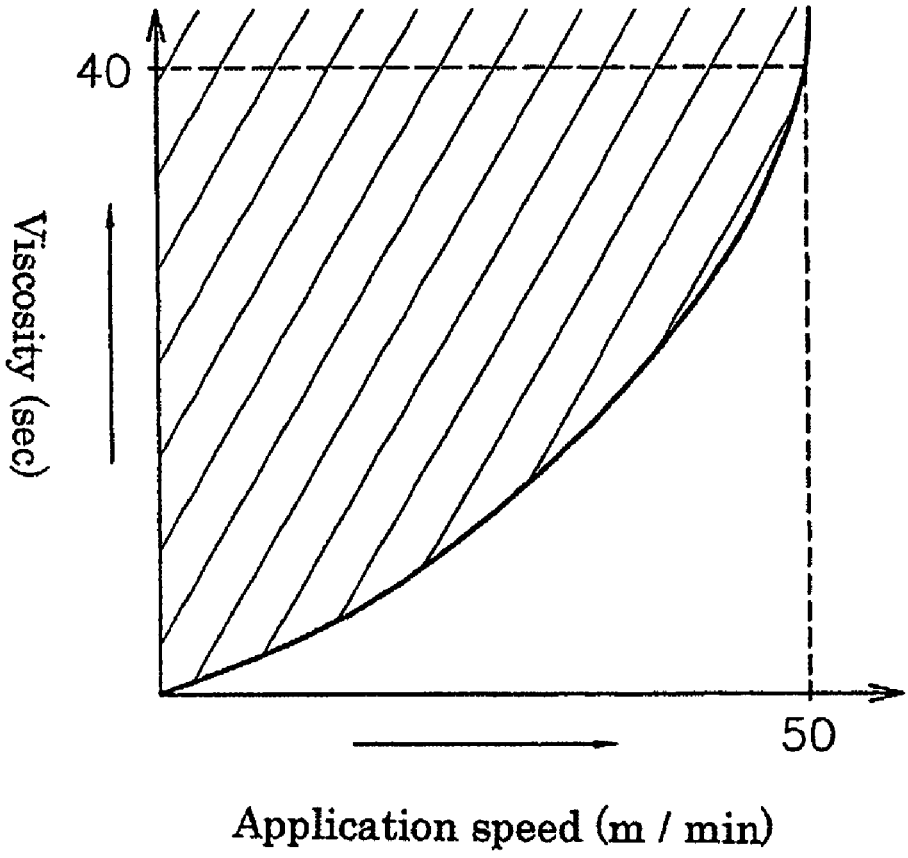
FIG. 2 is a graph showing the relationship between the speed at which the coating used in the aforementioned surface treatment method is applied and the viscosity of the coating.

An epoxy resin coating is employed as the corrosion resistant coating. The viscosity of the coating that can be employed here is related to the speed at which the coating is applied to the plate material 1. More specifically, a coating is used which has a viscosity in a range represented by the diagonal lines in FIG. 2. Note that when the application speed is high, a coating with a low viscosity cannot be used in the present method. This is because when the viscosity is low, the coating cannot be satisfactorily retained on the rollers of the roll coater 25, and thus cannot be satisfactorily applied to the plate material 1. Thus, for example, when the application speed is 50 m/min, it is preferable to use a coating having a viscosity of 40 sec or higher. Note that in conventional surface treatments, the coating is applied at a speed of between 100 and 250 m/min.

In addition, after the coating application, the plate material 1 is transported to the drying oven 23, and dried in atmospheric air at a temperature between 240 and 270° C. Here, the plate material 1 is dried at a temperature that is lower than the drying temperature used in the subsequent hydrophilic coating application step.

In the hydrophilic coating application step, a hydrophilic coating is applied to the surfaces of the plate material 1 by means of the roll coater 35. In this step, the coating is applied at a fixed speed by transporting the plate material 1 to the left in FIG. 1 at a fixed speed. The application speed is identical to that at which the corrosion resistant coating was applied.

An acrylic resin coating is employed as the hydrophilic coating. The viscosity of the hydrophilic coating that can be employed here is related to the application speed in the same way as that of the corrosion resistant coating. In addition, in this step, the hydrophilic coating is dried in the same atmospheric air where the corrosion resistant coating was dried, however as noted above, the temperature at which the hydrophilic coating is dried is higher than the temperature at which the corrosion resistant coating is dried.

In this surface treatment method, the plate material 1 is first transported from the coiler 21 toward the coiler 31. Next, the plate material 1 has a corrosion resistant coating applied thereto by means of the roll coater 25 without carrying out a degreasing treatment and a chromic acid treatment. Then, after a processing agent is affixed to the plate material 1 by the processing unit 27, the plate material 1 is heated up to the aforementioned predetermined temperature inside the drying oven 23, and the coating is dried and hardened. After that, the plate material 1 is cooled by the cooling blower 29 and wound by the coiler 31.

Next, the plate material 1 is transported from the coiler 31 toward the coiler 21, while the hydrophilic coating is applied by the roll coater 35. Then, after a processing agent is affixed to the plate material 1 by the processing unit 37, the plate material 1 is heated up to the aforementioned predetermined temperature inside the drying oven 23, and the coating is dried and hardened. After that, the plate material 1 is cooled by the cooling blower 39 and wound by the coiler 21.

According to this surface treatment method, the coating is applied to the plate material 1 at a speed that is comparatively slower than the conventional speed, and thus a coating having a comparatively high viscosity can be employed. Because of this, even if rolling oil remains on the plate material 1, a coating can be prevented from being repelled by the rolling oil and a coating film can be formed. Then, by applying this method, a conventional degreasing treatment and surface roughing treatment can be omitted, and thus a treatment layer for each treatment will not be necessary and costs will be greatly reduced.

In addition, in this method, there will be no need to treat waste fluid and the running costs for surface treatment will be avoided because the chromic acid treatment can be omitted.

[Cooling Fins for a Heat Exchanger]

Figure 3:
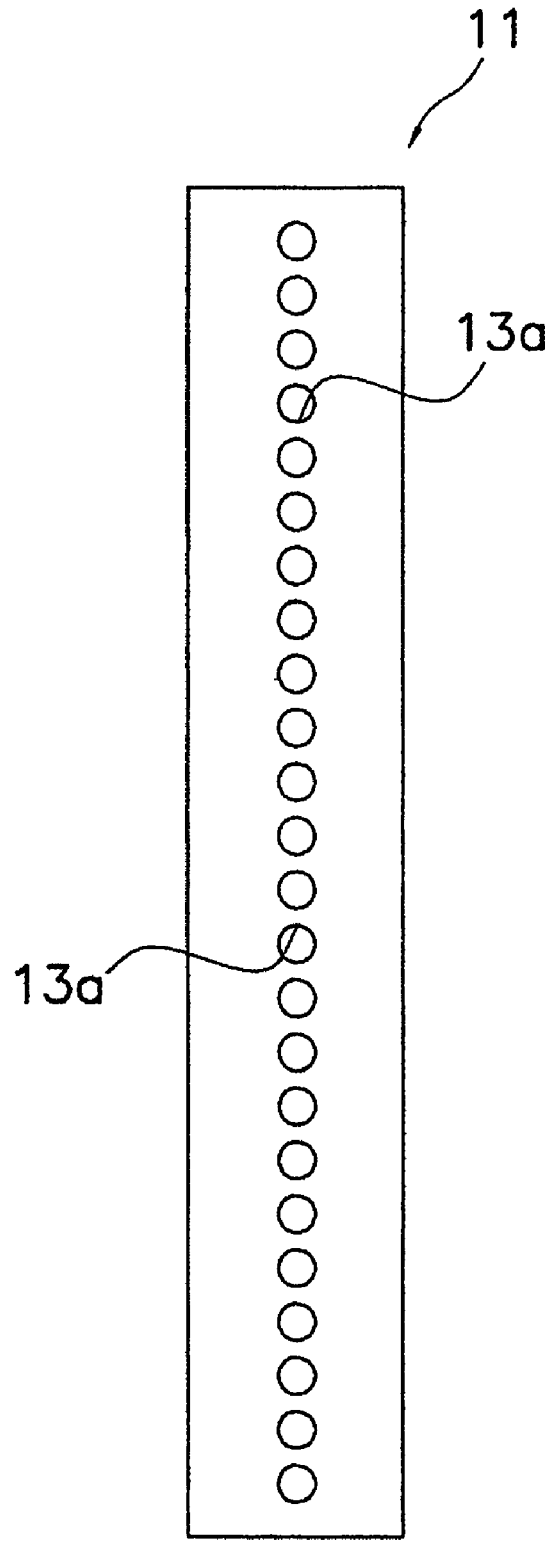
FIG. 3 is a plan view showing a cooling fin for a heat exchanger according to an embodiment of the present invention.
Figure 4:
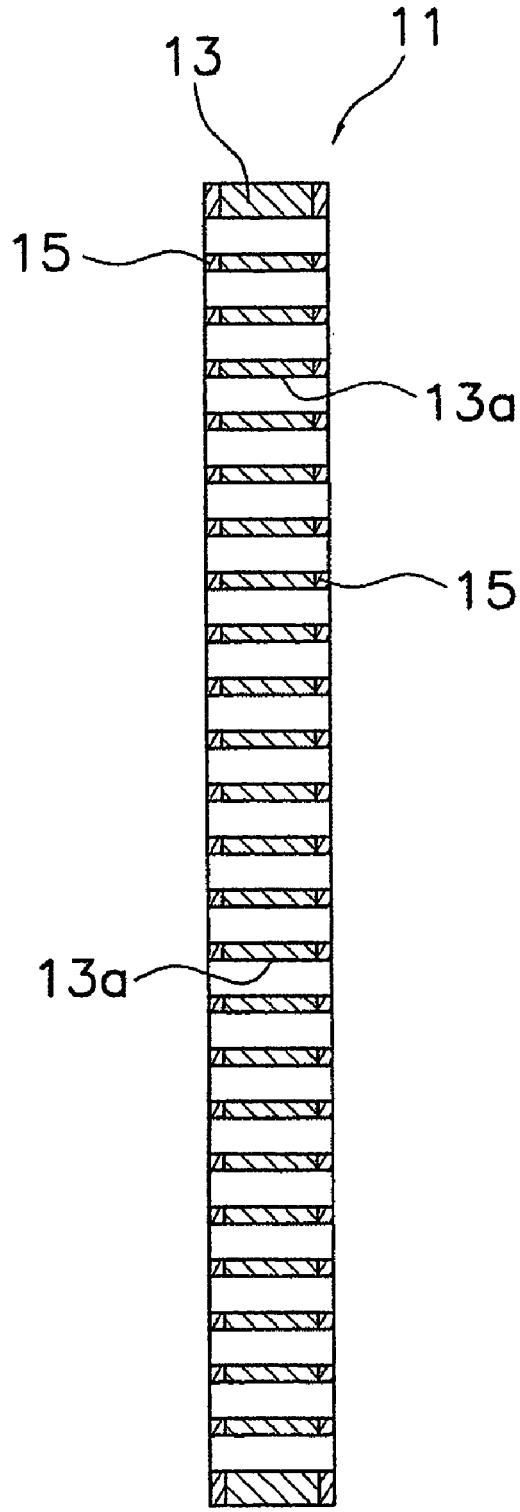
FIG. 4 is a longitudinal cross-section of the aforementioned cooling fin.

FIGS. 3 and 4 show a cooling fin 11 for a heat exchanger which is employed in an embodiment of the present invention.

The cooling fin 11 is a plate-shaped fin for radiating heat that is disposed inside a heat exchanger. The cooling fin 11 is composed of the plate material 1 that has been treated by means of the aforementioned surface treatment method, and includes a fin unit 13 and a coating film 15.

The fin unit 13 is manufactured by cutting the plate material 1 into a predetermined fin shape by means of a metal die, and forming it into the shape shown in the figures. In addition, the fin unit 13 includes a plurality of holes 13*a* in which a plurality of heat transfer lines (not shown in the figures) that are disposed inside the heat exchanger pass through the holes 13*a*.

The coating film 15 is formed on the surfaces of the fin unit 13. The coating film 15 includes 10 mg or less of a rolling oil per each 1 $m^2$ of the surface of the fin unit 13. In addition, the coating film 15 has a peak in the infrared spectrum in a range between 1500 $cm^{-1}$ and 2000 $cm^{-1}$. Furthermore, the surface of the coating film 15 has convex and concave portions thereon whose heights and depths in the plate thickness direction are in a range between 2 and 5 micrometers when measured by a scanning electron microscope (SEM).

The cooling fin 11 obtained by the aforementioned surface treatment includes a predetermined amount of rolling oil because a degreasing treatment is not carried out. In addition, when the infrared spectrum was measured, it was confirmed that a degreasing treatment was not performed because a peak appeared that showed the presence of rolling oil. Furthermore, when the concave and convex portions on the surface of the coating film 15 were measured by a scanning electron microscope, it was confirmed that a chromic acid treatment was not performed because the concave and convex portions were in a range that were comparatively smaller than when a surface treatment that includes a chromic acid treatment was performed.

In addition, the cooling fin 11 is primarily used as a cooling fin for a heat exchanger for an indoor unit because a hydrophilic coating is formed on the surface thereof.

Other Embodiments (a) The aforementioned surface treatment method may be employed in a surface treatment of a plate material for manufacturing cooling fins employed in a heat exchanger for devices other than outdoor and indoor units of an air conditioner.

(b) The aforementioned surface treatment method may only include the application of a corrosion resistant coating to the plate material. Here, this plate material can be used primarily for cooling fins for a heat exchanger of an outdoor unit.

(c) The aforementioned surface treatment method may employ a coating that affixes a predetermined coloring agent. Here, the film thickness of a coating film can be visually confirmed by the degree of color (lightness and darkness) because the portions of the coating film that are not repelled by the rolling oil will be colored and visible.

INDUSTRIAL APPLICABILITY

According to the present invention, a coating can be applied to a plate material without performing a degreasing treatment, and thus a conventional degreasing treatment tank will not be necessary and costs for equipment will be reduced.

What is claimed is:

1. A fin composed of a plate material having a non-degreased, non-surface roughened surface at least partially coated with a rolling oil and having a plate shape, comprising:

a fin unit having the non-degreased, non-surface roughened surface at least partially coated with the rolling oil; and a coating film that is formed on the non-degreased, non-surface roughened surface of the fin unit that is at least partially coated with the rolling oil, the coating film including a corrosion resistant coating applied to the non-degreased, non-surface roughened surface of the fin unit that is at least partially coated with the rolling oil and a hydrophilic coating applied to the corrosion resistant coating;

wherein in response to infrared spectrum measurement the coating film exhibits a peak in the infrared spectrum corresponding to the primary constituent of the rolling oil, and concave and convex portions on the surfaces of the coating film are in a range between 2 and 5 micrometers in the plate thickness direction.

2. The fin set forth in claim 1, wherein 10 mg or less of the rolling oil is included per 1 $m^2$ of the surface of the fin unit.

3. The fin set forth in claim 1, wherein the peak in the infrared spectrum exhibited by the coating film is in a range between 1500 $cm^{-1}$ and 2000 $cm^{-1}$.

4. The fin set forth in claim 2 is configured and arranged for radiating heat from a heat exchanger.

5. The fin set forth in claim 2, wherein the plate material is made from pure aluminum.

6. The fin set forth in claim 1 for radiating heat is configured and arranged for radiating heat from a heat exchanger.

7. The fin set forth in claim 1, wherein the plate material is made from pure aluminum.

8. The fin set forth in claim 7, wherein an epoxy resin is employed as the corrosion resistant coating.

9. The fin set forth in claim 8, wherein an acrylic resin coating is employed as the hydrophilic coating.

10. The fin set forth in claim 7, wherein an acrylic resin coating is employed as the hydrophilic coating.

11. The fin set forth in claim 1, wherein an epoxy resin is employed as the corrosion resistant coating.

12. The fin set forth in claim 11, wherein an acrylic resin coating is employed as the hydrophilic coating.

13. The fin set forth in claim 1, wherein an acrylic resin coating is employed as the hydrophilic coating.

* * * * *